US010657919B2

(12) United States Patent
Li

(10) Patent No.: US 10,657,919 B2
(45) **Date of Patent: *May 19, 2020**

(54) GATE DRIVING CIRCUIT, DRIVING METHOD, AND DISPLAY DEVICE

(71) Applicant: Wuhan China Star Optoelectronics Technology Co., Ltd., Wuhan, Hubei (CN)

(72) Inventor: Yafeng Li, Wuhan (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/327,305

(22) PCT Filed: Dec. 29, 2016

(86) PCT No.: PCT/CN2016/113027
§ 371 (c)(1),
(2) Date: Oct. 22, 2018

(87) PCT Pub. No.: WO2018/107533
PCT Pub. Date: Jun. 21, 2018

(65) Prior Publication Data

US 2019/0213969 A1 Jul. 11, 2019

(30) Foreign Application Priority Data

Dec. 15, 2016 (CN) ..... 2016 1 1160173

(51) Int. Cl.
*G09G 3/36* (2006.01)
*G09G 3/3266* (2016.01)
*G09G 3/20* (2006.01)

(52) U.S. Cl.
CPC ..... *G09G 3/3677* (2013.01); *G09G 3/20* (2013.01); *G09G 3/3266* (2013.01);
(Continued)

(58) Field of Classification Search
CPC combination set(s) only.
See application file for complete search history.

(56) References Cited

U.S. PATENT DOCUMENTS

2010/0177082 A1* 7/2010 Joo ..... G09G 3/3677 345/211
2015/0294734 A1* 10/2015 Chan ..... G11C 19/28 327/109

FOREIGN PATENT DOCUMENTS

CN 101364446 A 2/2009
CN 102184719 A 9/2011
(Continued)

OTHER PUBLICATIONS

Chinese Office Action for related Chinese Application No. 201611160173.5; action dated Aug. 28, 2018; (5 pages).
(Continued)

*Primary Examiner* — Md Saiful A Siddiqui

(57) ABSTRACT

Disclosed are a gate driving circuit and a driving method thereof, and a display device using the driving circuit. In the gate driving circuit, a $Q_n$ node in a $n^{th}$-stage circuit is precharged when a $Q_{n-1}$ node output signal in a previous-stage driving circuit and a $Q_{n+1}$ node output signal in a next-stage driving circuit are both at high levels, and thus stability of a $G_n$ output end in the $n^{th}$-stage circuit can be greatly improved. Meanwhile, a first transistor and a second transistor are connected in series, and a third transistor and a fourth transistor are connected in series.

19 Claims, 3 Drawing Sheets

(52) U.S. Cl.
CPC ..... *G09G 2300/0426* (2013.01); *G09G 2300/0809* (2013.01); *G09G 2310/08* (2013.01)

(56) References Cited

FOREIGN PATENT DOCUMENTS

| | | | | |
|---|---|---|---|---|
| CN | 102819998 | A | | 12/2012 |
| CN | 104282255 | A | * | 1/2015 |
| CN | 104715732 | A | | 6/2015 |
| CN | 104851383 | A | | 8/2015 |
| CN | 105469760 | A | | 4/2016 |
| CN | 106128379 | A | | 11/2016 |
| KR | 20100083370 | A | | 7/2010 |

OTHER PUBLICATIONS

International Search Report and Written Opinion for related International Application No. PCT?CN2016/113027; report dated Aug. 24, 2017; (13 pages).

* cited by examiner

GATE DRIVING CIRCUIT, DRIVING METHOD, AND DISPLAY DEVICE

CROSS-REFERENCE TO RELATED APPLICATIONS

The present application claims the priority of Chinese patent application CN201611160173.5, entitled "Gate driving circuit, driving method, and display device" and filed on Dec. 15, 2016, the entirety of which is incorporated herein by reference.

FIELD OF THE INVENTION

The present disclosure relates to the technical field of displaying, and in particular, to a gate driving circuit and a driving method thereof, and a display device manufactured according to the gate driving circuit and the driving method.

BACKGROUND OF THE INVENTION

Thin Film Transistor Liquid Crystal Display (TFT-LCD) devices and Active Matrix Driving OLED (OLED) display devices are increasingly applied to high-performance display fields as they are characterized by small size, low power consumption, no radiation and relatively low costs.

The above display devices are usually provided with gate driver on array circuits, in which a gate row scan drive signal circuit is formed on a thin film transistor array substrate by using a thin film transistor array process in the existing TFT-LCD. An output end of each stage of the gate driver on the array circuit is connected with a gate line for outputting a gate scan signal to the gate line, so as to scan gate lines row by row.

With development of an LTPS (low temperature polysilicon) semiconductor thin film transistor and due to the characteristic that the LTPS semiconductor itself has an ultra-high carrier mobility, a corresponding integrated circuit at the periphery of a panel also becomes a focus of interest, and many people devote themselves to related technical research on SOPs (systems on panel), which is gradually practical.

According to the way by which the existing gate driver on array circuit is connected, a signal may be attenuated during transmission from a previous stage to a current stage when the number of stages of gate driver on array circuits is increased. Once the signal transmitted between the gate driver on array circuits is attenuated, a precharge capability of a certain stage of gate driver on array circuit to a point Q will be weakened, which will further attenuate output capability of a gate driving signal of a current stage and finally affect charging of a pixel electrode in a display panel.

SUMMARY OF THE INVENTION

One of the technical problems to be solved by the present disclosure is to provide a gate driving circuit in which a gate driving signal $G_n$ of each stage can be output stably during signal transmission between multiple stages of gate driving circuits. Another technical problem to be solved by the present disclosure is to decrease the probability of electric leakage at a precharge node in the gate driving circuit.

In order to solve the above technical problems, the present disclosure, at a first aspect, provides a gate driving circuit comprising a multi-stage structure. An $n^{th}$-stage circuit comprises:

a $Q_n$ node precharge unit, which is configured to control signal transmission between a high-voltage signal VGH and a $Q_n$ node under action of a first input signal $Q_{n-1}$ and a second input signal $Q_{n+1}$ so as to precharge the $Q_n$ node;

a $Q_n$ node pull-up unit, which is electrically connected between the $Q_n$ node and an output end $G_n$ of a current-stage circuit for maintaining the $Q_n$ node in a high-level state;

a $Q_n$ node pull-down unit, which is electrically connected between a low-voltage signal VGL and the $Q_n$ node for controlling signal transmission between the low-voltage signal VGL and the $Q_n$ node under action of a $P_n$ node voltage signal so as to maintain the $Q_n$ node in a low-level state;

a $P_n$ node pull-up unit, which is electrically connected between the high-voltage signal VGH and a $P_n$ node for controlling signal transmission between the high-voltage signal VGH and the $P_n$ node under action of a first clock signal so as to maintain the $P_n$ node in a high-level state;

a $P_n$ node pull-down unit, which is electrically connected between the low-voltage signal VGL and the $P_n$ node for controlling signal transmission between the low-voltage signal VGL and the $P_n$ node under action of a $Q_n$ node voltage signal so as to maintain the $P_n$ node in a low-level state;

a $G_n$ output unit, which is electrically connected between a second clock signal and the output end $G_n$ of the current-stage circuit for controlling signal transmission between the second clock signal and the output end $G_n$ of the current-stage circuit under action of the $Q_n$ node voltage signal so as to output a $G_n$ high-level signal; and a $G_n$ output end pull-down unit, which is electrically connected between the low-voltage signal VGL and the output end $G_n$ of the current-stage circuit for controlling signal transmission between the low-voltage signal VGL and the output end $G_n$ of the current-stage circuit under action of the $P_n$ node voltage signal so as to maintain the output end $G_n$ of the current-stage circuit in a low-level state.

The first input signal $Q_{n-1}$ is a $Q_{n-1}$ node output signal in a previous-stage driving circuit, and the second input signal $Q_{n+1}$ is a $Q_{n+1}$ node output signal in a next-stage driving circuit.

In one embodiment, the $Q_n$ node precharge unit comprises a first transistor, a second transistor, a third transistor and a fourth transistor. The first transistor has a source connected with the high-voltage signal VGH, a gate connected with the second input signal $Q_{n+1}$, and a drain connected with a source of the second transistor; the second transistor has a gate connected with the first input signal $Q_{n-1}$, and a drain connected with a source of the third transistor and simultaneously connected with the $Q_n$ node; the third transistor has a gate connected with the first input signal $Q_{n-1}$, and a drain connected with a source of the fourth transistor; and the fourth transistor has a gate connected with the second input signal $Q_{n+1}$, and a drain connected with the high-voltage signal VGH.

In one embodiment, the $Q_n$ node pull-up unit comprises a first capacitor having two ends respectively connected with the $Q_n$ node and the output end $G_n$.

In one embodiment, the $Q_n$ node pull-down unit comprises a fifth transistor having a source connected with the $Q_n$ node, a gate connected with the $P_n$ node and a drain connected with the low-voltage signal VGL.

In one embodiment, the $P_n$ node pull-up unit comprises a sixth transistor and a second capacitor. The sixth transistor has a source connected with the high-voltage signal VGH, a gate connected with the first clock signal and a drain connected with the $P_n$ node. Two ends of the second capacitor are respectively connected with the $P_n$ node and the low-voltage signal VGL.

In one embodiment, the $P_n$ node pull-down unit comprises a seventh transistor. The seventh transistor has a source connected with the $P_n$ node, a gate connected with the $Q_n$ node and a drain connected with the low-voltage signal VGL.

In one embodiment, the $G_n$ output unit comprises an eighth transistor. The eighth transistor has a source connected with the second clock signal, a gate connected with the $Q_n$ node and a drain connected with the output end $G_n$.

In one embodiment, the $G_n$ output end pull-down unit comprises a ninth transistor. The ninth transistor has a source connected with the output end $G_n$, a gate connected with the $P_n$ node and a drain connected with the low-voltage signal VGL.

The present disclosure, at a second aspect, provides a gate driving method. During a forward scan and reverse scan, the gate driving method comprises the following phases.

During the forward scan, the gate driving method comprises the following phases.

phase a: when the first input signal $Q_{n-1}$ and the second input signal $Q_{n+1}$ are both at high levels, a first transistor and a second transistor are turned on in series, a third transistor and a fourth transistor are also turned on in series, and the $Q_n$ node is precharged simultaneously.

phase b: the $Q_n$ node is precharged during phase a, and a first capacitor C1 in the $Q_n$ node pull-up unit maintains the $Q_n$ node in a high-level state; an eighth transistor in the $G_n$ output unit is in an on state, and a high level of the second clock signal is output to the output end $G_n$.

phase c: the first capacitor in the $Q_n$ node pull-up unit continues to maintain the $Q_n$ node in the high-level state; a low level of the second clock signal pulls down a level of the $G_n$ output end at this time; when the first input signal $Q_{n-1}$ and the second input signal $Q_{n+1}$ are simultaneously at the high levels, the first transistor, the second transistor, the third transistor and the fourth transistor are all turned on in series, and the $Q_n$ node is supplementarily charged.

phase d: when the first clock signal is at a high level, a sixth transistor in the $P_n$ node pull-up unit is in an on state; a level of the $P_n$ node is pulled up; a fifth transistor in the $Q_n$ node pull-down unit is turned on, and a level of the $Q_n$ node is pulled down to a low-voltage signal VGL at this time.

phase e: after the Qn node is pulled down to a low level, a seventh transistor in the $P_n$ node pull-down unit is in an off state; when the first clock leaps to the high level, the six transistor is turned on and the $P_n$ node is charged; then both the fifth transistor and a ninth transistor of the $G_n$ output end pull-down unit are turned on; stability of the low levels of the $Q_n$ node and the output end $G_n$ can be ensured, and meanwhile, a second capacitor plays a certain role in maintaining the $P_n$ node at the high level.

During the reverse scan, the gate driving method comprises the following phases.

phase 1: when the first input signal $Q_{n-1}$ and the second input signal $Q_{n+1}$ are at the high levels, the first transistor and the second transistor are turned on in series, the third transistor and the fourth transistor are also turned on in series, and the $Q_n$ node is precharged simultaneously.

phase 2: the $Q_n$ node is precharged during the phase 1, and the first capacitor C1 in the $Q_n$ node pull-up unit maintains the $Q_n$ node in the high-level state; the eighth transistor in the $G_n$ output unit is in the on state, and the high level of the second clock signal is output to the output end $G_n$.

phase 3: the first capacitor C1 in the $Q_n$ node pull-up unit continues to maintain the $Q_n$ node in the high-level state; the low level of the second clock signal pulls down the level of the $G_n$ output end at this time; and when the first input signal $Q_{n-1}$ and the second input signal $Q_{n+1}$ are simultaneously at the high levels, the first transistor, the second transistor, the third transistor and the fourth transistor are all turned on in series and the $Q_n$ node is supplementarily charged.

phase 4: when the first clock signal is at the high level, the sixth transistor T6 in the $P_n$ node pull-up unit is in the on state, and the level of the $P_n$ node is pulled up; the fifth transistor T5 in the $Q_n$ node pull-down unit is turned on, and the level of the $Q_n$ node is pulled down to the low-voltage signal VGL at this time.

phase 5: after the $Q_n$ node is pulled down to the low level, the seventh transistor T7 in the $P_n$ node pull-down unit is in the off state; when the first clock leaps to the high level, the six transistor T6 is turned on and the $P_n$ node is charged; then both the fifth transistor T5 and the ninth transistor T9 of the $G_n$ output end pull-down unit are turned on; stability of the low level of the $Q_n$ node and the output end $G_n$ can be ensured, and meanwhile, the second capacitor C2 plays a certain role in maintaining the $P_n$ node at the high level.

The present disclosure, at a third aspect, provides a display device, which comprises the gate driving circuit described in any of the above embodiments.

Compared with the prior art, one or more embodiments of the present disclosure may have the following advantages.

In the gate driving circuit of the present disclosure, in regard to the $n^{th}$-stage circuit, the $Q_n$ node in the $n^{th}$-stage circuit is precharged when the $Q_{n-1}$ node output signal in the previous-stage driving circuit and the $Q_{n+1}$ node output signal in the next stage driving circuit are both at the high levels, and thus stability of the $G_n$ output end in the nth-stage circuit can be greatly improved. Meanwhile, the first transistor and the second transistor are connected in series, the third transistor and the fourth transistor are connected in series, and thus the probability of electric leakage of the $Q_n$ node can be greatly decreased.

Other features and advantages of the present disclosure will be further explained in the following description, and partly become self-evident therefrom, or be understood through implementation of the present disclosure. The objectives and advantages of the present disclosure will be achieved through the structure specifically pointed out in the description, claims, and the accompanying drawings.

BRIEF DESCRIPTION OF THE DRAWINGS

The drawings are provided for further understanding of the present disclosure, and constitute one part of the description. They serve to explain the present disclosure in conjunction with the embodiments, rather than to limit the present disclosure in any manner. In the drawings.

DESCRIPTION OF REFERENCE NUMERALS

1. $Q_n$ node precharge unit;
2. $Q_n$ node pull-up unit;

3. $Q_n$ node pull-down unit;
4. $P_n$ node pull-up unit;
5. $P_n$ node pull-down unit;
6. $G_n$ output unit;
7. $G_n$ output end pull-down unit;
8. High-voltage signal VGH;
9. Low-voltage signal VGL;
10. $Q_n$ node;
11. First input signal $Q_{n-1}$
12. Second input signal $Q_{n+1}$;
13. $P_n$ node; and
14. Output end $G_n$.

DETAILED DESCRIPTION OF THE EMBODIMENTS

In order to present the purpose, technical solution, and advantages of the present disclosure more explicitly, the present disclosure will be further explained in detail in conjunction with the accompanying drawings.

Figure 1:
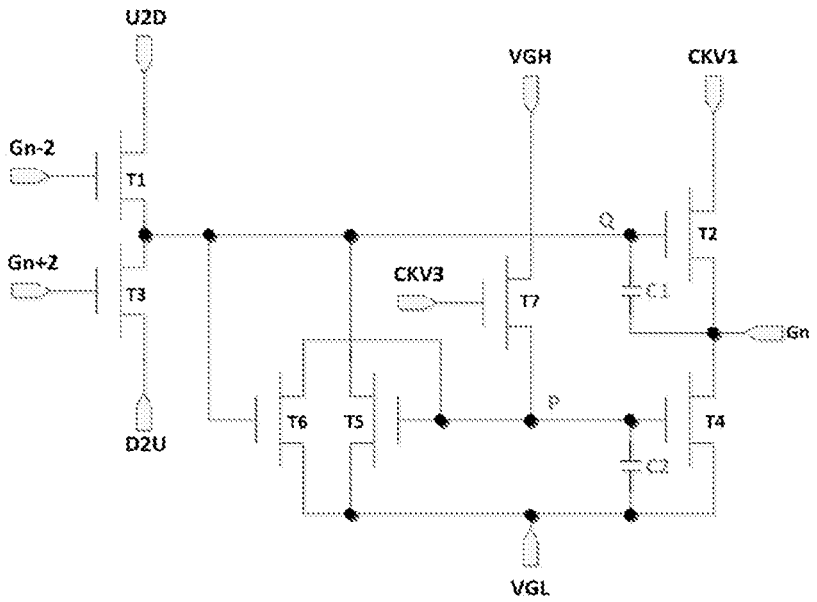
Fig. 1 (Prior Art)
FIG. 1 shows a gate driving circuit in the prior art.
Figure 2:
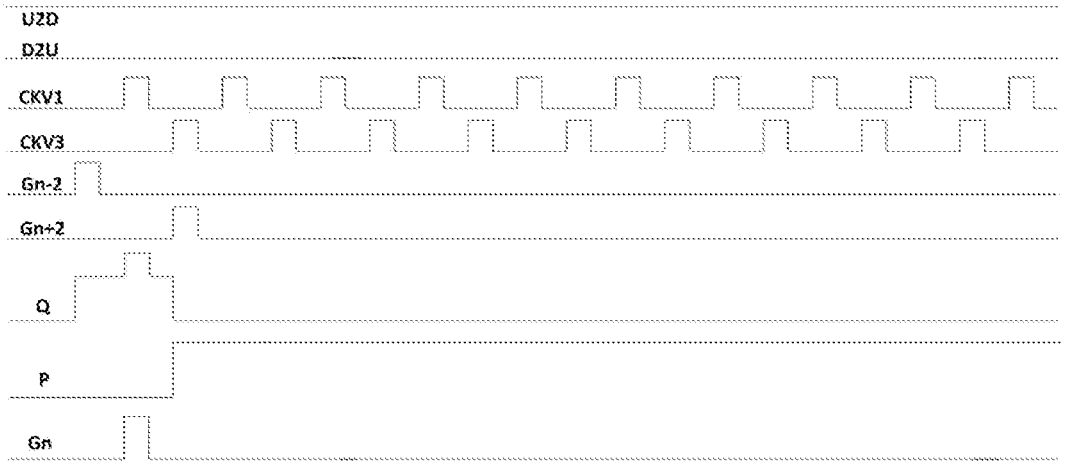
Fig. 2 (Prior Art)
FIG. 2 is a timing chart of forward scan of the gate driving circuit in the prior art.
Figure 3:
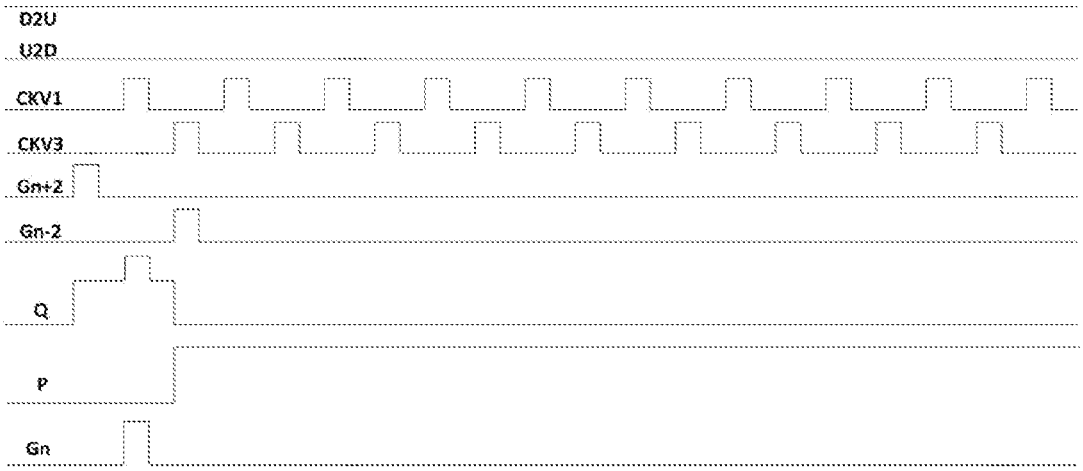
Fig. 3 (Prior Art)
FIG. 3 is a timing chart of reverse scan of the gate driving circuit in the prior art.

FIG. 1 shows structure of a certain-stage circuit unit in a traditional gate driver on array circuit, and in order to guarantee stability of an output point $G_n$, Q node and P node are introduced. During a forward scan of the circuit, a signal timing diagram of the circuit is as shown in FIG. 2, and during a reverse scan, a signal timing diagram of the circuit is as shown in FIG. 3.

According to the way by which a gate driver on array circuit is connected, a signal may be attenuated during transmission from a previous stage to a current stage when the number of stages of gate driver on array circuits is increased. Once the signal is attenuated, precharge capability of a certain stage of gate driver on array circuit to a point Q will be weakened, which will further attenuate output capability of a gate driving signal $G_n$ of a current stage and finally affect charging of a pixel electrode in a display panel.

In view of the above, the present disclosure provides a new gate driver on array circuit, which is a gate driving circuit in which a gate drive signal $G_n$ of each stage can be output stably during e transmission between multi-stage gate driver on array circuits.

Embodiment 1

Figure 4:
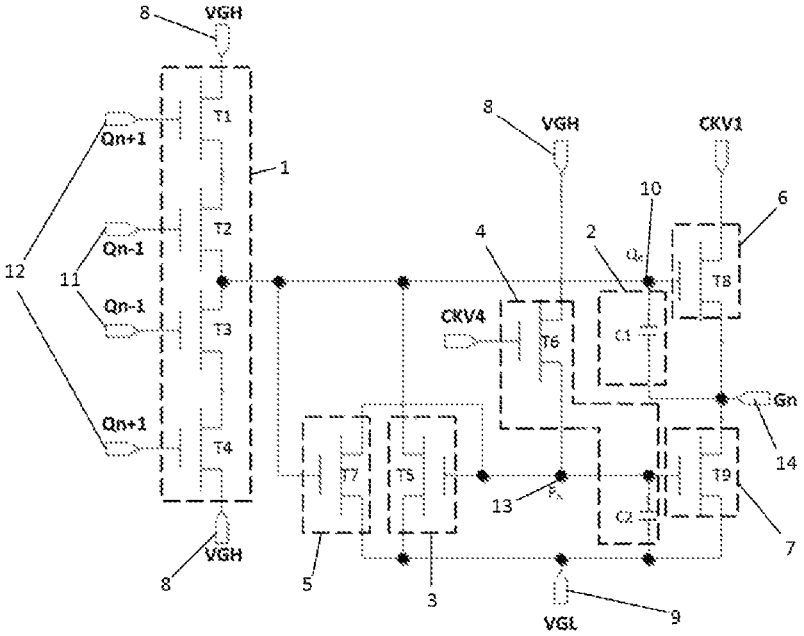
FIG. 4 shows a gate driving circuit according to the present disclosure.

FIG. 4 shows a gate driving circuit according to the present embodiment. The gate driving circuit is described in conjunction with FIG. 4 below.

As shown in FIG. 4, the gate driving circuit comprises multiple stages of gate driving circuits. An $n^{th}$-stage gate driving circuit comprises a $Q_n$ node precharge unit 1, a $Q_n$ node pull-up unit 2, a $Q_n$ node pull-down unit 3, a $P_n$ node pull-up unit 4, a $P_n$ node pull-down unit 5, a $G_n$ output unit 6, and a $G_n$ output end pull-down unit 7.

The $Q_n$ node precharge unit 1 is connected with a first input signal $Q_{n-1}$ 11, a second input signal $Q_{n+1}$ 12 and a high-voltage signal VGH8. The first input signal $Q_{n-1}$ 11 is a $Q_{n-1}$ node output signal in a previous-stage driving circuit, and the second input signal $Q_{n+1}$ 12 is a $Q_{n+1}$ node output signal in a next-stage driving circuit. The first input signal $Q_{n-1}$ 11 and the second input signal $Q_{n+1}$ 12 control signal transmission between the high-voltage signal VGH8 and a $Q_n$ node 10 through the $Q_n$ node precharge unit 1 so as to pre-charge the $Q_n$ node 10.

The $Q_n$ node precharge unit 1 comprises a first transistor T1, a second transistor T2, a third transistor T3 and a fourth transistor T4. The first transistor T1 has a source connected with the high-voltage signal VGH8, a gate connected with the second input signal $Q_{n+1}$ 12, and a drain connected with a source of the second transistor T2. The second transistor T2 has a gate connected with the first input signal $Q_{n-1}$ 11, and a drain connected with a source of the third transistor T3 and simultaneously connected with the $Q_n$ node 10. The third transistor T3 has a gate connected with the first input signal $Q_{n-1}$ 11, and a drain connected with a source of the fourth transistor T4. The fourth transistor T4 has a gate connected with the second input signal $Q_{n+1}$12, and a drain connected with the high-voltage signal VGH8.

The $Q_n$ node pull-up unit 2 is used for maintaining the $Q_n$ node 10 in a high level state. The $Q_n$ node pull-up unit 2 comprises a first capacitor C1, and two ends of the first capacitor C1 are respectively connected with the $Q_n$ node 10 and an output end $G_n$ 14.

The $Q_n$ node pull-down unit 3 is connected with a low-voltage signal VGL9 and is used for maintaining the $Q_n$ node 10 in a low level state. The $Q_n$ node pull-down unit 3 comprises a fifth transistor T5 having a source connected with the $Q_n$ node 10, a gate connected with a $P_n$ node 13, and a drain connected with the low-voltage signal VGL9.

The $P_n$ node pull-up unit 4 is connected with the high-voltage signal VGH8 and a clock signal CKV4 for controlling signal transmission between the high-voltage signal VGH8 and the $P_n$ node 13. The $P_n$ node pull-up unit 4 comprises a sixth transistor T6 and a second capacitor C2. The sixth transistor T6 has a source connected with the high-voltage signal VGH8, a gate connected with the clock signal CKV4, and a drain connected with the $P_n$ node 13. Two ends of the second capacitor C2 are respectively connected with the $P_n$ node 13 and the low-voltage signal VGL9.

The $P_n$ node pull-down unit 5 is connected with the low-voltage signal VGL9 for maintaining the $P_n$ node 13 in a low level state. The $P_n$ node pull-down unit 5 comprises a seventh transistor T7 having a source connected with the $P_n$ node, a gate connected with the $Q_n$ node 10, and a drain connected with the low-voltage signal VGL9.

The $G_n$ output unit 6 is connected with a clock signal CKV1 and the output end $G_n$ 14 for controlling signal transmission between the clock signal CKV1 and the output end $G_n$ 14. In one embodiment, the $G_n$ output unit 6 comprises an eighth transistor T8 having a source connected with the clock signal CKV1, a gate connected with the $Q_n$ node 10, and a drain connected with the output end $G_n$ 14.

The $G_n$ output end pull-down unit 7 is connected with the low-voltage signal VGL9 and the output end $G_n$ 14 for maintaining the output end $G_n$ 14 in a low level state. The $G_n$ output end pull-down unit 7 comprises a ninth transistor T9 having a source connected with the output end $G_n$ 14, a gate connected with the $P_n$ node 13, and a drain connected with the low-voltage signal VGL9.

The embodiment has the following technical effects. With the gate driving circuit of the embodiment, the $Q_n$ node in the $n^{th}$-stage circuit is precharged when the $Q_{n-1}$ node output signal in the previous-stage driving circuit and the $Q_{n+1}$ node output signal in the next-stage driving circuit are both at high levels, and thus stability of the $G_n$ output end in the $n^{th}$-stage circuit can be greatly improved. Meanwhile, the first transistor and the second transistor are connected in series and the third transistor and the fourth transistor are connected in series, which greatly decreases probability of electric leakage at the $Q_n$ node.

Embodiment 2

According to the gate driving circuit of embodiment 1, the present embodiment provides a method for driving the above-mentioned gate driving circuit.

Figure 5:
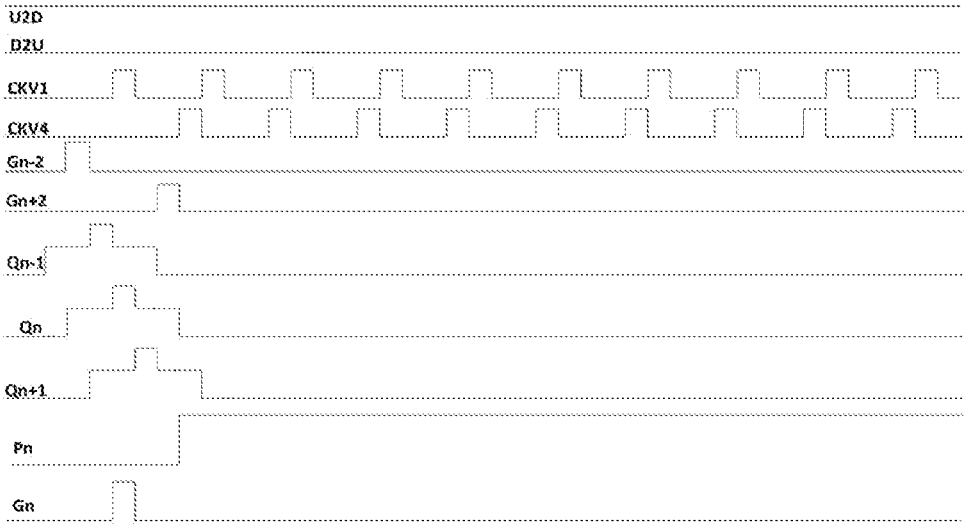
FIG. 5 is a timing chart of forward scan of the gate driving circuit according to the present disclosure.

During a forward scan, a signal timing diagram of the driving method is as shown in FIG. 5, and a scan process comprises phases a to e.

phase a: When a first input signal $Q_{n-1}$11 and a second input signal $Q_{n+1}$ 12 are both at high levels, a first transistor and a second transistor are turned on in series, a third transistor and a fourth transistor are also turned on in series, and a $Q_n$ node 10 is precharged simultaneously.

phase b: The $Q_n$ node 10 is precharged during phase a. A first capacitor C1 in a $Q_n$ node pull-up unit maintains the $Q_n$ node 10 in a high-level state. An eighth transistor T8 in a $G_n$ output unit 6 is in an on state. A high level of a second clock signal is output to an output end $G_n$ 14.

phase c: The first capacitor C1 in the $Q_n$ node pull-up unit 2 continues to maintain the $Q_n$ node 10 in the high-level state. A low level of the second clock signal pulls down a level of the output end $G_n$ 14 at this time. When the first input signal $Q_{n-1}$ 11 and the second input signal $Q_{n+1}$ 12 are simultaneously at high levels, the first transistor, the second transistor, the third transistor and the fourth transistor are all turned on in series and the $Q_n$ node 10 is supplementarily charged.

phase d: When a first clock signal is at a high level, a sixth transistor T6 in a $P_n$ node pull-up unit 4 is in an on state. In this case, a level of a $P_n$ node 13 is pulled up, a fifth transistor T5 in a $Q_n$ node pull-down unit 3 is turned on, and a level of the $Q_n$ node 10 is pulled down to a low-voltage signal VGL9.

phase e: A seventh transistor T7 in a $P_n$ node pull-down unit 5 is in an off state after the $Q_n$ node 10 changes to the low level. The six transistor T6 is turned on and the $P_n$ node 13 is charged when the first clock leaps to the high level. Then, both the fifth transistor T5 and a ninth transistor T9 of a $G_n$ output end pull-down unit 7 are turned on, and thus stability of the low levels of the $Q_n$ node 10 and the output end $G_n$ 14 are ensured. Meanwhile, a second capacitor C2 plays a certain role in maintaining the $P_n$ node 13 at the high level.

Figure 6:
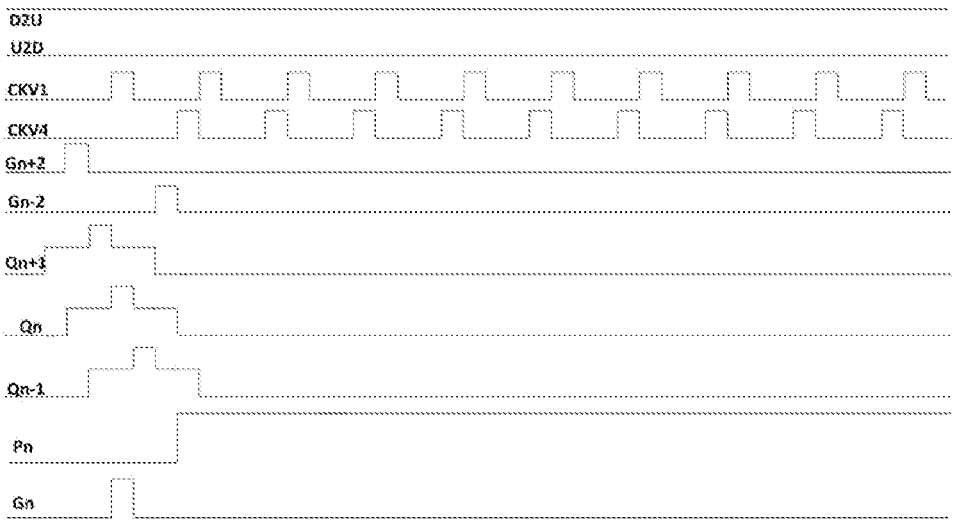
FIG. 6 is a timing chart of reverse scan of the gate driving circuit according to the present disclosure.

During a reverse scan, a signal timing diagram of the driving method is as shown in FIG. 6. In the $Q_n$ node precharge unit, the first transistor and the second transistor, and the third transistor and the fourth transistor are substantially symmetrical relative to the $Q_n$ node. Therefore, a reverse scan process is approximately the same as the forward scan process, and the difference only exists in that a first input signal $Q_{n-1}$ and a second input signal $Q_{n+1}$ are opposite relative to the forward scan. The scan process comprises phases 1 to 5.

phase 1: When the first input signal $Q_{n-1}$ 11 and the second input signal $Q_{n+1}$ 12 are both at high levels, the first transistor and the second transistor are turned on in series, the third transistor and the fourth transistor are also turned on in series, and the $Q_n$ node 10 is precharged simultaneously.

phase 2: The $Q_n$ node 10 is precharged during phase 1. The first capacitor C1 in the $Q_n$ node 10 pull-up unit maintains the $Q_n$ node in a high-level state. The eighth transistor T8 in the $G_n$ output unit 6 is in an on state, and a high level of the second clock signal is output to the output end $G_n$ 14.

phase 3: The first capacitor C1 in the $Q_n$ node 10 pull-up unit 2 continues to maintain the $Q_n$ node 10 in the high-level state, and a low level of the second clock signal pulls down a level of the output end $G_n$ 14 at this time. When the first input signal $Q_{n-1}$ 11 and the second input signal $Q_{n+1}$ 12 are simultaneously at high levels, the first transistor, the second transistor, the third transistor and the fourth transistor are all turned on in series and the $Q_n$ node 10 is supplementarily charged.

phase 4: When the first clock signal is at a high level, the sixth transistor T6 in the $P_n$ node pull-up unit 4 is in an on state. A level of the $P_n$ node 13 is pulled up, the fifth transistor T5 in the $Q_n$ node pull-down unit 3 is turned on, and the level of the $Q_n$ node 10 is pulled down to the low-voltage signal VGL9 at this time.

phase 5: The seventh transistor T7 in the $P_n$ node pull-down unit 5 is in an off state after the $Q_n$ node 10 changes to the low level. The six transistor T6 is turned on and the $P_n$ node is charged when the first clock leaps to the high level. Then, both the fifth transistor T5 and the ninth transistor T9 of the $G_n$ output end pull-down unit 7 are in an on state. Stability of the low levels of the $Q_n$ node 10 and the output end $G_n$ 14 are thus ensured. Meanwhile, the second capacitor C2 maintains the $P_n$ node 13 at a high level to certain degree.

The embodiment has the following technical effect. With the driving method of the embodiment, the $Q_n$ node in the $n^{th}$-stage circuit is precharged when the $Q_{n-1}$ node output signal in the previous stage driving circuit and the $Q_{n+1}$ node output signal in the next stage driving circuit are both at high levels, and thus stability of the $G_n$ output end in the nth-stage circuit can be greatly improved. Meanwhile, the first transistor and the second transistor are connected in series, and the third transistor and the fourth transistor are connected in series, which decreases the probability of electric leakage at the $Q_n$ node.

Embodiment 3

According to embodiment 1 and embodiment 2, the present embodiment provides a display device. The display device comprises a display panel and a peripheral driving circuit. The display panel can be a liquid crystal display panel, a plasma display panel, a light emitting diode display panel or an organic light emitting diode display panel and the like. The peripheral drive circuit comprises a gate driving circuit and an image signal driving circuit. The gate driving circuit adopts the gate driving circuit as described in embodiment 1. When the display device of the embodiment runs, the gate driving circuit of the display device works in a way as the gate driving method described in embodiment 2.

The embodiment has the following technical effects. Signal output of the gate driving circuit of the display device of the present embodiment is stable, and therefore, the display effect of the display device is more stable than that of the display device in the prior art. Phenomenons such as residual image, image shaking and the like can be greatly reduced.

The above description should not be construed as limitations of the present disclosure, but merely as exemplifications of specific embodiments thereof. Any variations or replacements that can be readily envisioned by those skilled in the art are intended to be within the scope of the present disclosure.

The invention claimed is:

1. A gate driving circuit, comprising a multi-stage structure, wherein an $n^{th}$-stage circuit comprises:

a $Q_n$ node precharge unit, which is configured to control signal transmission between a high-voltage signal VGH and a $Q_n$ node under action of a first input signal $Q_{n-1}$ and a second input signal $Q_{n+1}$ so as to precharge the $Q_n$ node;

a $Q_n$ node pull-up unit, which is electrically connected between the $Q_n$ node and an output end $G_n$ of a current-stage circuit for maintaining the $Q_n$ node in a high-level state;

a $Q_n$ node pull-down unit, which is electrically connected between a low-voltage signal VGL and the $Q_n$ node for controlling signal transmission between the low-voltage signal VGL and the $Q_n$ node under action of a $P_n$ node voltage signal so as to maintain the $Q_n$ node in a low-level state;

a $P_n$ node pull-up unit, which is electrically connected between the high-voltage signal VGH and a $P_n$ node for controlling signal transmission between the high-voltage signal VGH and the $P_n$ node under action of a first clock signal so as to maintain the $P_n$ node in a high-level state;

a $P_n$ node pull-down unit, which is electrically connected between the low-voltage signal VGL and the $P_n$ node for controlling signal transmission between the low-voltage signal VGL and the $P_n$ node under action of a $Q_n$ node voltage signal so as to maintain the $P_n$ node in a low-level state;

a $G_n$ output unit, which is electrically connected between a second clock signal and the output end $G_n$ of the current-stage circuit for controlling signal transmission between the second clock signal and the output end $G_n$ of the current-stage circuit under action of the $Q_n$ node voltage signal so as to output a $G_n$ high-level signal; and a $G_n$ output end pull-down unit, which is electrically connected between the low-voltage signal VGL and the output end $G_n$ of the current-stage circuit for controlling signal transmission between the low-voltage signal VGL and the output end $G_n$ of the current-stage circuit under action of the $P_n$ node voltage signal so as to maintain the output end $G_n$ of the current-stage circuit in a low-level state, wherein the first input signal $Q_{n-1}$ is a $Q_{n-1}$ node output signal in a previous-stage driving circuit, and the second input signal $Q_{n+1}$ is a $Q_{n+1}$ node output signal in a next-stage driving circuit;

wherein the $Q_n$ node precharge unit comprises: a first transistor, a second transistor, a third transistor, and a fourth transistor, wherein the first transistor has a source connected with the high-voltage signal VGH, a gate connected with the second input signal $Q_{n+1}$, and a drain connected with a source of the second transistor, wherein the second transistor has a gate connected with the first input signal $Q_{n-1}$, and a drain connected with a source of the third transistor and simultaneously connected with the $Q_n$ node, wherein the third transistor has a gate connected with the first input signal $Q_{n-1}$, and a drain connected with a source of the fourth transistor, and wherein the fourth transistor has a gate connected with the second input signal $Q_{n+1}$, and a drain connected with the high-voltage signal VGH.

2. The gate driving circuit according to claim 1, wherein the $Q_n$ node pull-up unit comprises a first capacitor having two ends respectively connected with the $Q_n$ node and the output end $G_n$.

3. The gate driving circuit according to claim 2, wherein the $Q_n$ node pull-down unit comprises a fifth transistor, which has a source connected with the $Q_n$ node, a gate connected with the $P_n$ node and a drain connected with the low-voltage signal VGL.

4. The gate driving circuit according to claim 3, wherein the $P_n$ node pull-up unit comprises a sixth transistor and a second capacitor, wherein the sixth transistor has a source connected with the high-voltage signal VGH, a gate connected with the first clock signal and a drain connected with the $P_n$ node, and wherein two ends of the second capacitor are respectively connected with the $P_n$ node and the low voltage signal VGL.

5. The gate driving circuit according to claim 4, wherein the $P_n$ node pull-down unit comprises a seventh transistor, wherein the seventh transistor has a source connected with the $P_n$ node, a gate connected with the $Q_n$ node and a drain connected with the low-voltage signal VGL.

6. The gate driving circuit according to claim 5, wherein the $G_n$ output unit comprises an eighth transistor, wherein the eighth transistor has a source connected with the second clock signal, a gate connected with the $Q_n$ node and a drain connected with the output end $G_n$.

7. The gate driving circuit according to claim 6, the $G_n$ output end pull-down unit comprises a ninth transistor, wherein the ninth transistor has a source connected with the output end $G_n$, a gate connected with the $P_n$ node and a drain connected with the low-voltage signal VGL.

8. The gate driving circuit according to claim 1, wherein, the $Q_n$ node of the $n^{th}$-stage circuit is precharged when the $Q_{n-1}$ node output signal in the previous-stage driving circuit and the $Q_{n+1}$ node output signal in the next-stage driving circuit are both at high levels.

9. The gate driving circuit according to claim 1, wherein, the first transistor and the second transistor are connected in series and the third transistor and the fourth transistor are connected in series when the $Q_n$ node of the $n^{th}$-stage circuit is precharged.

10. A display device, comprising a display panel and a peripheral driving circuit; wherein, the peripheral drive circuit comprises the gate driving circuit of claim 1 and an image signal driving circuit.

11. A driving method of a gate driving circuit, wherein the gate driving circuit has a multi-stage structure, wherein an $n^{th}$-stage circuit comprises:

a $Q_n$ node precharge unit, which is configured to control signal transmission between a high-voltage signal VGH and a $Q_n$ node under action of a first input signal $Q_{n-1}$ and a second input signal $Q_{n+1}$ so as to precharge the $Q_n$ node;

a $Q_n$ node pull-up unit, which is electrically connected between the $Q_n$ node and an output end $G_n$ of a current-stage circuit for maintaining the $Q_n$ node in a high-level state;

a $Q_n$ node pull-down unit, which is electrically connected between a low-voltage signal VGL and the $Q_n$ node for controlling signal transmission between the low-voltage signal VGL and the $Q_n$ node under action of a $P_n$ node voltage signal so as to maintain the $Q_n$ node in a low-level state;

a $P_n$ node pull-up unit, which is electrically connected between the high-voltage signal VGH and a $P_n$ node for controlling signal transmission between the high-voltage signal VGH and the $P_n$ node under action of a first clock signal so as to maintain the $P_n$ node in a high-level state;

a $P_n$ node pull-down unit, which is electrically connected between the low-voltage signal VGL and the $P_n$ node for controlling signal transmission between the low-voltage signal VGL and the $P_n$ node under action of a $Q_n$ node voltage signal so as to maintain the $P_n$ node in a low-level state;

a $G_n$ output unit, which is electrically connected between a second clock signal and the output end $G_n$ of the current-stage circuit for controlling signal transmission between the second clock signal and the output end $G_n$ of the current-stage circuit under action of the $Q_n$ node voltage signal so as to output a $G_n$ high-level signal; and a $G_n$ output end pull-down unit, which is electrically connected between the low-voltage signal VGL and the output end $G_n$ of the current-stage circuit for controlling signal transmission between the low-voltage signal VGL and the output end $G_n$ of the current-stage circuit under action of the $P_n$ node voltage signal so as to maintain the output end $G_n$ of the current-stage circuit in a low-level state, wherein the first input signal $Q_{n-1}$ is a $Q_{n-1}$ node output signal in a previous-stage driving circuit, and the second input signal $Q_{n+1}$ is a $Q_{n+1}$ node output signal in a next-stage driving circuit, and wherein in the driving method of the gate driving circuit, a forward scan phase comprises:

phase a: when the first input signal $Q_{n-1}$ and the second input signal $Q_{n+1}$ are both at high levels, a first transistor and a second transistor are turned on in series, a third transistor and a fourth transistor are also turned on in series, and the $Q_n$ node is precharged simultaneously;

phase b: the $Q_n$ node is precharged during phase a, and a first capacitor C1 in the $Q_n$ node pull-up unit maintains the $Q_n$ node in a high-level state; an eighth transistor in the $G_n$ output unit is in an on state, and a high level of the second clock signal is output to the output end $G_n$;

phase c: the first capacitor in the $Q_n$ node pull-up unit continues to maintain the $Q_n$ node in the high-level state; a low level of the second clock signal pulls down a level of the $G_n$ output end at this time; when the first input signal $Q_{n-1}$ and the second input signal $Q_{n+1}$ are simultaneously at the high levels, the first transistor, the second transistor, the third transistor and the fourth transistor are all turned on in series, and the $Q_n$ node is supplementarily charged;

phase d: when the first clock signal is at a high level, a sixth transistor in the $P_n$ node pull-up unit is in an on state; a level of the $P_n$ node is pulled up; a fifth transistor in the $Q_n$ node pull-down unit is turned on, and a level of the $Q_n$ node is pulled down to a low-voltage signal VGL at this time; and phase e: after the $Q_n$ node is pulled down to a low level, a seventh transistor in the $P_n$ node pull-down unit is in an off state; when the first clock leaps to the high level, the six transistor is turned on and the $P_n$ node is charged; then both the fifth transistor and a ninth transistor of the $G_n$ output end pull-down unit are turned on; stability of the low levels of the $Q_n$ node and the output end $G_n$ can be ensured, and meanwhile, a second capacitor plays a certain role in maintaining the $P_n$ node at the high level.

12. The driving method of the gate driving circuit according to claim 11, wherein the driving method further comprises a reverse scan phase, which comprises:

phase 1: when the first input signal $Q_{n-1}$ and the second input signal $Q_{n+1}$ are at the high levels, the first transistor and the second transistor are turned on in series, the third transistor and the fourth transistor are also turned on in series, and the $Q_n$ node is precharged simultaneously;

phase 2: the $Q_n$ node is precharged during the phase 1, and the first capacitor C1 in the $Q_n$ node pull-up unit maintains the $Q_n$ node in the high-level state; the eighth transistor in the $G_n$ output unit is in the on state, and the high level of the second clock signal is output to the output end $G_n$;

phase 3: the first capacitor C1 in the $Q_n$ node pull-up unit continues to maintain the $Q_n$ node in the high-level state; the low level of the second clock signal pulls down the level of the $G_n$ output end at this time; and when the first input signal $Q_{n-1}$ and the second input signal $Q_{n+1}$ are simultaneously at the high levels, the first transistor, the second transistor, the third transistor and the fourth transistor are all turned on in series and the $Q_n$ node is supplementarily charged;

phase 4: when the first clock signal is at the high level, the sixth transistor T6 in the $P_n$ node pull-up unit is in the on state, and the level of the $P_n$ node is pulled up; the fifth transistor T5 in the $Q_n$ node pull-down unit is turned on, and the level of the $Q_n$ node is pulled down to the low-voltage signal VGL at this time; and phase 5: after the $Q_n$ node is pulled down to the low level, the seventh transistor T7 in the $P_n$ node pull-down unit is in the off state; when the first clock leaps to the high level, the six transistor T6 is turned on and the $P_n$ node is charged; then both the fifth transistor T5 and the ninth transistor T9 of the $G_n$ output end pull-down unit are turned on; stability of the low level of the $Q_n$ node and the output end $G_n$ can be ensured, and meanwhile, the second capacitor C2 plays a certain role in maintaining the $P_n$ node at the high level.

13. The driving method of the gate driving circuit according to claim 11, wherein the $Q_n$ node precharge unit comprises: a first transistor, a second transistor, a third transistor, and a fourth transistor, wherein the first transistor has a source connected with the high-voltage signal VGH, a gate connected with the second input signal $Q_{n+1}$, and a drain connected with a source of the second transistor;

wherein the second transistor has a gate connected with the first input signal $Q_{n-1}$, and a drain connected with a source of the third transistor and simultaneously connected with the $Q_n$ node;

wherein the third transistor has a gate connected with the first input signal $Q_{n-1}$, and a drain connected with a source of the fourth transistor; and wherein the fourth transistor has a gate connected with the second input signal $Q_{n+1}$, and a drain connected with the high-voltage signal VGH.

14. The driving method of the gate driving circuit according to claim 13, wherein the $Q_n$ node pull-up unit comprises a first capacitor having two ends respectively connected with the $Q_n$ node and the output end $G_n$.

15. The driving method of the gate driving circuit according to claim 14, wherein the $Q_n$ node pull-down unit comprises a fifth transistor having a source connected with the $Q_n$ node, a gate connected with the $P_n$ node and a drain connected with the low-voltage signal VGL.

16. The driving method of the gate driving circuit according to claim 15, wherein the $P_n$ node pull-up unit comprises a sixth transistor and a second capacitor, wherein a source of the sixth transistor is connected with the high voltage signal VGH, a gate of the sixth transistor is connected with the first clock signal, and a drain of the sixth transistor is connected with the $P_n$ node; and wherein two ends of the second capacitor are respectively connected with the $P_n$ node and the low voltage signal VGL.

17. The driving method of the gate driving circuit according to claim 16, wherein the $P_n$ node pull-down unit comprises a seventh transistor, wherein the seventh transistor has a source connected with the $P_n$ node, a gate connected with the $Q_n$ node and a drain connected with the low-voltage signal VGL.

18. The driving method of the gate driving circuit according to claim 17, the $G_n$ output unit comprises an eighth transistor, wherein the eighth transistor has a source connected with the second clock signal, a gate connected with the $Q_n$ node and a drain connected with the output end $G_n$.

19. The driving method of the gate driving circuit according to claim 18, the $G_n$ output end pull-down unit comprises a ninth transistor, wherein the ninth transistor has a source connected with the output end $G_n$, a gate connected with the $P_n$ node and a drain connected with the low-voltage signal VGL.

* * * * *